US005211289A

United States Patent [19]

Matthews

[11] Patent Number: 5,211,289

[45] Date of Patent: May 18, 1993

[54] REMOVABLE LID

[75] Inventor: Walter A. Matthews, Rothesay, Canada

[73] Assignee: Irving Oil Limited, New Brunswick, Canada

[21] Appl. No.: 888,308

[22] Filed: May 27, 1992

Related U.S. Application Data

[63] Continuation of Ser. No. 7,553,615, Jul. 18, 1990.

[30] Foreign Application Priority Data

Sep. 27, 1989 [CA] Canada ..... 613417

[51] Int. Cl.[5] ..... B65D 21/00

[52] U.S. Cl. ..... 206/508; 220/254; 220/355; 220/358; 220/367; 220/373

[58] Field of Search ..... 206/508; 220/254, 355, 220/358, 367, 373

[56] References Cited

U.S. PATENT DOCUMENTS

| | | | |
|---|---|---|---|
| 2,695,115 | 11/1954 | Roop | 206/508 |
| 2,754,866 | 7/1956 | Coltman | 220/254 |
| 3,272,671 | 9/1966 | Gaylord | 206/508 |
| 3,378,177 | 4/1968 | Gran | 206/508 |
| 3,474,928 | 10/1969 | Hurtt | 206/508 X |
| 3,516,571 | 6/1970 | Roper | 206/508 |
| 3,677,430 | 7/1972 | Yates | 206/508 |
| 3,942,679 | 3/1976 | Starr | 220/355 |
| 3,943,987 | 3/1976 | Rossi | 220/355 |
| 3,999,677 | 12/1976 | Oberkircher | 220/266 |
| 4,014,459 | 3/1977 | Robinson | 206/508 |
| 4,286,713 | 9/1981 | Marchais | 206/508 |
| 4,491,238 | 1/1985 | Tobult | 220/355 |
| 4,512,493 | 4/1985 | Von Holdt | 220/306 |
| 4,682,707 | 7/1987 | Wiles | 220/307 |
| 4,779,754 | 10/1988 | Ten Eyck et al. | 220/254 |
| 4,928,839 | 5/1990 | Kruelskie | 206/508 |

FOREIGN PATENT DOCUMENTS

| | | | |
|---|---|---|---|
| 0272644 | 6/1963 | Australia | 220/356 |

*Primary Examiner*—Allan N. Shoap
*Assistant Examiner*—Stephen Cronin
*Attorney, Agent, or Firm*—Mason, Fenwick & Lawrence

[57] ABSTRACT

There is provided a new and useful removable lid, particularly adapted for commercial sized containers of the type which holds oils, grease, bulk food stuffs and the like. The lid comprises a central lid area which has parallel upper and lower surfaces. A continuous channel extends about the periphery of the lower surface. The channel has inner and outer walls for releasably receiving therebetween the upper lid of a container. A skirt downwardly depends about the periphery of the lid area. The skirt forms part of the outer wall of the channel. Means at the bottom of the channel act as a seal between the lid and the container when the lid is in position on the container. In the present invention, the upper surface of the lid area is unindented, from the center of the lid to its periphery so as to provide no relatively lowered surface areas within which liquids could collect on the upper surface, and spaced reinforcing ribs extending from the inner wall inwardly on the lower surface to reinforce the lid area for supporting a stacked container thereon and to reinforce the inner wall of the channel.

5 Claims, 2 Drawing Sheets

REMOVABLE LID

This application is a continuation of application Ser. No. 07/553,615 filed Jul. 18, 1990.

FIELD OF THE INVENTION

The present invention relates to a removable lid of the type used on commercial-sized containers, such as barrels, for holding oils, grease, bulk food stuffs and the like. Such lids generally have a central lid area with parallel upper and lower surfaces and a continuous, inverted U-shaped channel extending about the periphery of the lower surface, the channel having inner and outer walls for releasably receiving therebetween the upper lip of the container. A skirt downwardly depends about the periphery of the lid area, the skirt forming part of the outer wall of the channel.

Usually means are provided at the bottom of the channel to act as a seal between the lid and the container when the lid is in position on the container.

Such containers may, for example be around the five gallon capacity. They are often stacked for storage purposes, and consequently the lids must be of very sturdy construction.

BACKGROUND OF THE INVENTION

Such lids in current use have suffered from a number of shortcomings. Since the containers must be stackable for storage, shipping and the like, the lids, which are generally constructed of plastic, must be capable of supporting the stacked containers. Presently, such lids have been able to achieve the necessary strength only through a support system which mandates that the central part of the lid, involving almost the entire upper surface of the lid, is recessed below its perimeter portions. A very substantial problem which arises in lids of this type is that water and other liquids collect in the recessed portion. As there are openings in the central part of the lid, for example for pouring, a leakage problem occurs. This may occur because as liquid or other material in the container cools, for example over night, a vacuum is created which serves to suck the liquid which has collected on the upper surface of the lid, through the sealing around such openings, so that the liquid in the container becomes contaminated.

Another problem with such containers in the past has been that the opening for pouring, being in the recessed portion of the lid, requires that liquid must be poured quickly enough to clear the raised perimeter of the lid.

PRIOR ART

U.S. Pat. No. 4,779,754 of Ten Eyck et al., issued Oct. 25, 1988, describes and illustrates a lid which attempts to solve some of these problems. The lid of this patent has an inner rim on the upper surface, the function of which is to vertically center and laterally stabilize stacked containers. That rim is provided with a series of notches or openings to allow liquid on the top surface to drain off. An outer rim is also provided on this upper surface, spaced from the inner rim, with a series of notches therein, this outer rim to provide additional strength to the lid and strengthen the outer wall of the channel, so that the lid will stay on a container for example, when the container is dropped. This construction results in an indentation, on the upper surface between the inner and outer rims, which must be filled if water is not to collect on the top of the container. Further indentations in the upper surface of the container include stress rings at the center of the central lid area and a recessed portion about the main opening of the lid. These depressions again provide areas where water can collect on the top of the lid.

Another reference of interest is Chase et al., U.S. Pat. No. 3,927,790 which describes and illustrates not a lid for a container, but an entire, molded container. While, consequently, that subject matter is structurally materially different than the draining lid of the present invention, Chase's molded container is of interest in that at one end, where apertures for filling and emptying the container are provided, those apertures are mounted on a flat surface having upstanding, circumferentially spaced ridges, spaces between the ridges forming water run-off areas.

Other references of general background interest include:

| U.S. Pat. No. | Issue Date | Inventor |
|---|---|---|
| 1,746,332 | February 11, 1930 | Barroll |
| 2,130,678 | September 20, 1938 | Cisco |
| 4,545,178 | March 13, 1951 | Vaughn |
| Design Patent 162,903 | April 10, 1951 | Trautvetter |
| 2,624,486 | January 6, 1953 | Lee |
| Design Patent 181,131 | October 8, 1957 | Crosio |
| 2,823,826 | February 18, 1958 | Moore |
| Design Patent 239,505 | April 13, 1976 | Ward |
| 3,972,450 | August 3, 1976 | Walters |
| 4,201,306 | May 6, 1980 | Dubois, et al. |
| 4,753,362 | June 28, 1988 | Galer |
| **Canadian Patent No.** | **Issued** | **Inventor** |
| 892,980 | February 15, 1972 | Roper, et al. |
| 727,442 | February 8, 1966 | Goldsmith |
| 718,202 | September 21, 1965 | Speas |
| 1,029,317 | April 11, 1978 | Galer |

It is an object of the present invention to provide a removable lid for containers having improved water run-off characteristics on its upper surface.

SUMMARY OF THE INVENTION

In accordance with the present invention there is provided a removable lid, particularly adapted for commercial sized containers of the type which holds oils, grease, bulk food stuffs and the like. The lid comprises a central lid area which has parallel upper and lower surfaces. A continuous inverted U-shaped channel extends about the periphery of the lower surface. The channel has inner and outer walls for releasably receiving therebetween the upper lip of a container. A skirt downwardly depends about the periphery of the lid area. The skirt forms part of the outer wall of the channel. Means at the bottom of the channel act as a seal between the lid and the container when the lid is in position on the container. In the present invention, the upper surface of the lid area is unindented, from the center of the lid to its periphery so as to provide no relatively lowered surface areas within which liquids could collect on the separate surface. Spaced reinforcing ribs extend on the lower surface from the inner wall of the channel inwardly to reinforce the lid area for supporting a stacked container thereon and to reinforce that inner wall.

In a preferred embodiment of the present invention, an upstanding ridge is spaced inwardly from the periphery, on the upper surface. The ridge is broken at spaced locations about its perimeter to provide for fluid run-off at those locations. The ridge is to receive against lateral displacement the bottom of a container when stacked on the lid. As well, the lid is provided with an opening inwardly spaced from and adjacent to one of said locations. The sides of the opening have a circumscribing lip upwardly extending from the upper surface of the lid area.

The lid according to the present invention avoids many of the shortcomings of previously known and used container lids. Its construction provides the necessary strength to support other containers stacked thereon and to hold the container lid in place even when for example, the container is dropped. Nevertheless, at the same time, its construction avoids recesses in the upper surface of the lid, or any portion thereof, to avoid or significantly minimize the collection of water or other liquids on the top of the container lid.

BRIEF DESCRIPTION OF THE DRAWINGS

These and other objects and advantages of the invention will become apparent upon reading the following detailed description and upon referring to the drawings in which.

Figure 1:
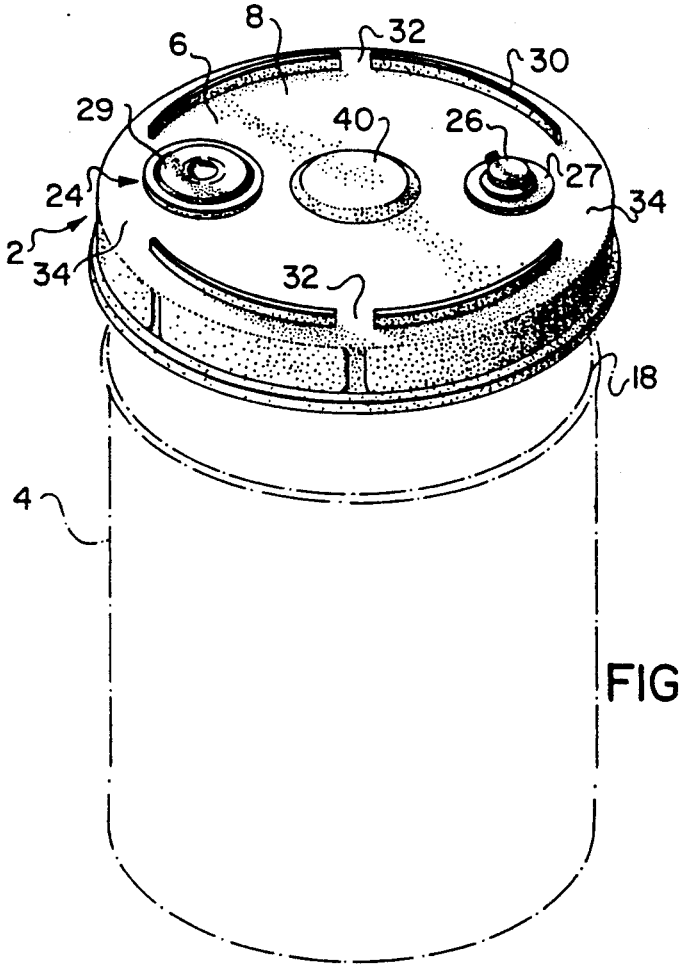
FIG. 1 is a perspective view of the top surface of lid in accordance with the present invention.

While the invention will be described in conjunction with an example embodiment, it will be understood that it is not intended to limit the invention to such embodiment. On the contrary, it is intended to cover all alternatives, modifications and equivalents as may be included within the spirit and scope of the invention as defined by the appended claims.

DETAILED DESCRIPTION OF THE INVENTION

In the drawings, similar features have been given similar reference numerals.

Figure 2:
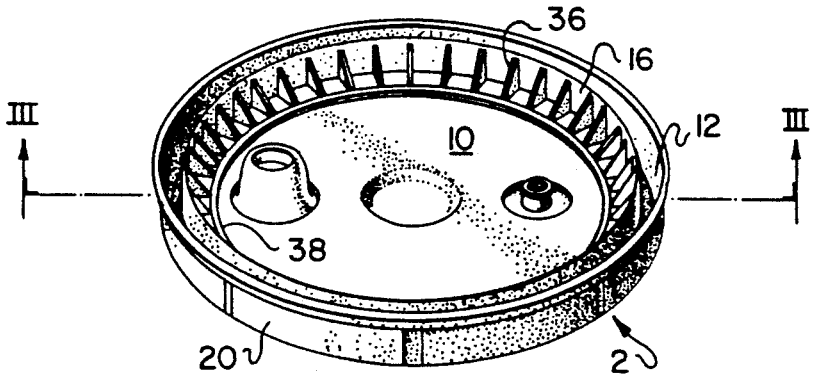
FIG. 2 is a perspective view of the bottom of the lid of FIG. 1.

Turning to the drawings, FIGS. 1 and 2 illustrate a removable lid 2 for commercial-sized containers 4 (shown in phantom in FIG. 1) in accordance with the present invention. The lid 2 may be for example molded from any type of sturdy plastic material. The lid is of the type which comprises a central lid area 6 having parallel upper and lower surfaces 8 and 10 respectively. A continuous channel 12 of inverted U-shape and having an outer wall 14 and an inner wall 16 is provided, extending downwardly about the periphery of lower surface 10 is provided for releasably receiving the upper lip 18 of container 4. Skirt 20, of which outer wall 14 is an integral part, depends downwardly about the periphery of lid area 6 as illustrated. It should be noted that skirt 20 depends downwardly to a greater degree than inner wall 16. This facilitates the insertion and removal of lid 2 with respect to container 4. A sealer ring 22 made for example of rubber or the like, is provided to act as a seal and between the lid and upper lip 18 of the container when the lid is in position on the container.

Capped openings or apertures 24 and 26 (air hole) are provided through the upper surface 8 of central lid area 6. It should be noted that portion 27, circumscribing aperture 26, is elevated with respect to the circumscribing upper surface of central lid area 6 therebeyond, another feature tending to minimize the chance for liquid on the upper surface 8 to pass into a container 4 on which lid 2 is placed. Opening 24, from which the contents of the container on which the lid is placed may be poured, has an upstanding lip 28 to which cap 29 is affixed. This upstanding lip is designed so as to receive a standard crimp-on type of cap 29. Alternatively, the outer surface of lip 28 may be threaded to receive a screw on cap.

Figure 3:
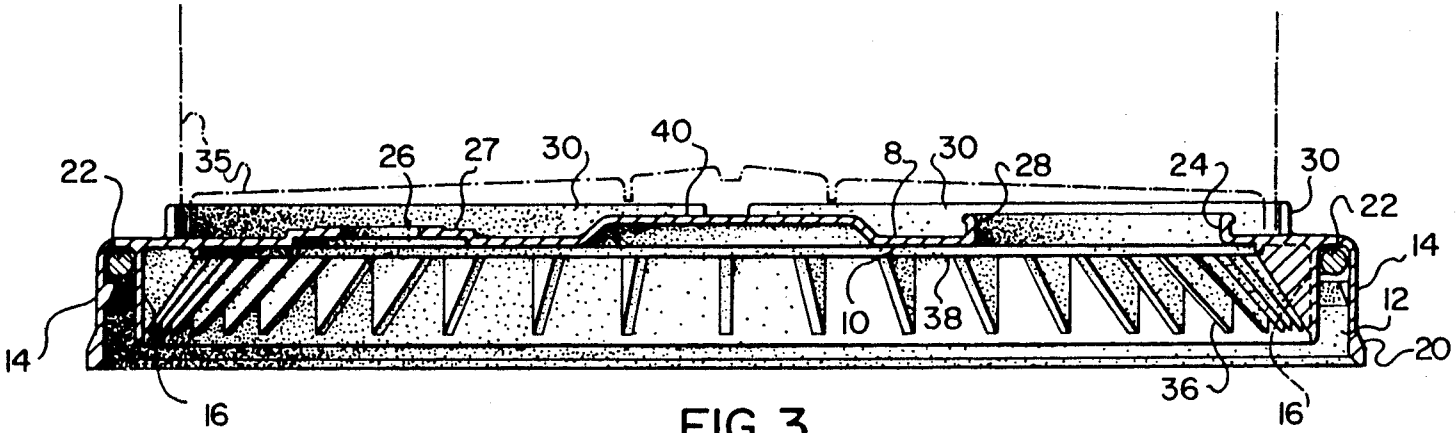
FIG. 3 is a section view along line III—III of FIG. 2.

In the illustrated embodiment, the lid is of circular form. As can be seen in FIGS. 1 and 3, the upper surface of the lid area is unindented, from the center of the lid to its periphery, along any radius. Thus, there are no depressions, grooves or other forms of relatively lowered surface areas, on this upper surface within which liquids can collect on this upper surface.

An upstanding ridge 30 is spaced inwardly from the periphery of the lid 2, this ridge being broken at spaced locations 32 and 34 to provide for fluid run-off at those locations. It is preferred that openings 24 and 26 be inwardly spaced from and adjacent to the wider of the break locations, locations 34, to minimize the chance that water will collect around these openings and facilitate water run-off from these areas. This ridge is positioned so as to receive the bottom downwardly-extending flange portion 35 (FIG. 3, phantom) of another container 4 to be stacked on lid 2 so that this bottom portion 35 fits inside or outside of ridge 30 to avoid lateral displacement of such container when stacked on lid 2. As well, ridge 30 strengthens and provides greater structural integrity for lid 2.

On lower surface 10, extending inwardly from inner wall 16 of channel 12 are a plurality of spaced, radially aligned ribs 36, the function of which is to reinforce inner wall 16 against its lateral displacement which might otherwise tend to cause the upper lip 18 of container 4 to become dislodged from channel 12 when lid 2 is in position on the top of container 4, as well as to strengthen central lid area 6 so that it is not readily deformed for example when another container or containers 4 are stacked on top of it. These ribs 36 extend inwardly and downwardly from the inner surface of inner wall 16 (as illustrated in FIG. 3) to a low, downwardly depending ridge 38 which extends parallel to inner wall 16, spaced inwardly therefrom, on lower surface 10. As can be see from FIG. 3, ridge 38 and ribs 36 extend inwardly beyond the inner periphery of ridge 30. Ridge 38 also provides for increased structural integrity of lid 2.

A central portion 40 of central lid area 6 is elevated, as illustrated, with respect to the rest of the lid area, and takes the place of previously known indented stress rings. This elevated portion 40 again further facilitates the run-off of liquids from the top surface 8 of lid 2.

The upper surface 8 of central lid area 6 may be formed with a slight, convex curvature along diagonal lines, to further facilitate the run-off of liquid on upper surface 8, and reduce the chance that such liquid can collect thereon.

The lid in accordance with the present invention is extremely effective in ensuring little or no collection of water on its upper surface. Also its relatively simple construction provides for significant structure integrity of the lid for example in resisting collapse when other containers are stacked on its top surface 8, and to resist unintentional removal of lid 2 from a container 4 for example when the container is dropped or knocked.

Thus it is apparent that there has been provided in accordance with the invention a removable lid for commercial-sized containers that fully satisfies the objects, aims and advantages set forth above. While the invention has been described in conjunction with a specific embodiment thereof, it is evident that many alternatives, modifications and variations will be apparent to those skilled in the art in light of the foregoing description. Accordingly, it is intended to embrace all such alternatives, modifications and variations as fall within the spirit and broad scope of the invention.

What I claim as my invention:

1. A removable lid for commercial-sized containers for holding oils, grease, bulk food stuffs, and the like, the containers having an upper lip and a bottom, downwardly-extending flange, said lid comprising:

a central lid area having, at least in part, parallel, substantially horizontal upper and lower surfaces, a central portion and an outer periphery, said upper surface being substantially planar from said central portion to said outer periphery to provide unobstructed flow paths for liquid on said central lid area to said outer periphery;

receiving means for releasably receiving the upper lip of a container, said receiving means comprising a resilient skit downwardly depending about said periphery of said central lid area and an inner wall spaced inwardly from said skirt and downwardly depending from said lower surface of said lid, said skirt and said inner wall defining a continuous inverted peripherally extending U-shaped channel extending downwardly from said lower surface of said lid, said channel having a bottom defined by said lower surface of said central lid area between said skirt and said inner wall;

retaining means for retaining the bottom, downwardly-extending flange of a second container against lateral displacement when the second container is stacked on said lid, said retaining means comprising an upstanding ridge on said upper surface inwardly spaced from said periphery, said ridge having inner and outer peripheries and a series of spaced openings therethrough, at least one of said spaced openings being substantially wider than the others of said spaced openings, and said upstanding ridge being spaced inwardly from said inner wall;

sealing means at said bottom of said channel for forming a seal between said lid and the container when said lid is in position on the container, said sealing means seating on the upper lip of the container;

a first opening in said lid for receiving a pouring spout, said first opening having a circumscribing lip upwardly extending from and integral with said upper surface of said lid, said first opening being spaced inwardly of said ridge and adjacent said substantially wider spaced opening through said ridge;

a small, raised area on said upper surface of said lid spaced inwardly of said ridge and located substantially diametrically opposite to said first opening;

a second opening in said lid for receiving an air venting plug, said second opening being located in said small raised area and having a smaller diameter than said small raised area; and reinforcing means for reinforcing said inner wall against lateral displacement and for reinforcing said central lid area against deformation when a second container is stacked on said lid, said reinforcing means comprising a plurality of spaced triangular, radial, reinforcing ribs extending between said lower surface and said inner wall of said channel inwardly beyond said inner periphery at said ridge, whereby a second container stacked on said lid with its bottom peripheral edge within said ridge will receive substantial support from said reinforcing ribs.

2. A removable lid according to claim 1, said central portion having an upper surface elevated with respect to the upper surface of said central lid area outwardly thereof.

3. A removable lid according to claim 1 wherein said inner wall of said channel is of lesser height than said outer wall.

4. A removable lid according to claim 3 wherein said lid further comprises a low, downwardly depending ridge spaced inwardly from and extending parallel to said inner wall of said channel about said lower surface and said reinforcing ribs extend inwardly from said top of said inner wall to said downwardly depending ridge.

5. A removable lid for commercial-sized containers for holding oils, grease, bulk food stuffs, and the like, the containers having an upper lip and a bottom, downwardly-extending flange, said lid comprising:

a central lid area having, at least in part, parallel, substantially horizontal upper and lower surfaces, a central portion and an outer periphery, said upper surface being substantially planar from said central portion to said outer periphery to provide unobstructed flow paths for liquid on said central lid area to said outer periphery;

receiving means for releasably receiving the upper lip of a container, said receiving means comprising a resilient skirt downwardly depending about said periphery of said central lid area and an inner wall spaced inwardly from said skirt and downwardly depending from said lower surface of said lid, said skirt and said inner wall defining a continuous inverted peripherally extending U-shaped channel extending downwardly from said lower surface of said lid, said channel having a bottom defined by said lower surface of said central lid area between said skirt and said inner wall;

retaining means for retaining the bottom, downwardly-extending flange of a second container against lateral displacement when the second container is stacked on said lid, said retaining means comprising an upstanding ridge on said upper surface inwardly spaced from said periphery, said ridge having inner and outer peripheries and a series of spaced openings therethrough; at least one of said spaced openings being substantially wider than the others of said spaced openings, a first opening in said lid for receiving a pouring spout, said first opening having a circumscribing lip upwardly extending from and integral with said upper surface of said lid, said first opening being spaced inwardly of said ridge and adjacent said substantially wider spaced opening through said ridge;

a small, raised area on said upper surface of said lid spaced inwardly of said ridge and located substantially diametrically opposite to said first opening;

a second opening in said lid for receiving an air venting plug, said second opening being located in said small raised area and having a smaller diameter than said small raised area; and reinforcing means for reinforcing said inner wall against lateral displacement and for reinforcing said central lid area against deformation when the container is stacked on said lid.

* * * * *